United States Patent [19]

Knapp

[11] Patent Number: 4,891,906

[45] Date of Patent: Jan. 9, 1990

[54] INTERLOCKING DOOR GUARD

[76] Inventor: Walter R. Knapp, 7020 SE. 87th, Portland, Oreg. 97266

[21] Appl. No.: 294,106

[22] Filed: Jan. 6, 1989

[51] Int. Cl.[4] ..... E05C 21/02
[52] U.S. Cl. ..... 49/65; 49/62
[58] Field of Search ..... 49/65, 63, 67, 62, 54, 49/163

[56] References Cited

U.S. PATENT DOCUMENTS

| | | | |
|---|---|---|---|
| 2,177,617 | 10/1939 | Hinton | 49/65 X |
| 3,832,805 | 9/1974 | Stevens | 49/67 X |
| 4,644,688 | 2/1987 | Benderoff | 49/67 |

FOREIGN PATENT DOCUMENTS

| | | | |
|---|---|---|---|
| 540659 | 3/1931 | Fed. Rep. of Germany | 70/DIG. 65 |

*Primary Examiner*—Philip C. Kannan

[57] ABSTRACT

An interlocking door guard securely covers and is attached to the outside of doors that open inward. It uses a full length pendulum torsion rod assembly on the hinge side of the door as well as guides in connection therewith and matching receptacles in and/or on both vertical casing members to accommodate mating sections of door guard. The forward section has an open area adequate to access door locks. This area is further protected by adjustable guard bars. Hinge lever assemblies attached to the door and guard in the forward area cause it to shift and interlock and disengage both vertical casing members when encountering stop plates on forward casing receptacles.

9 Claims, 1 Drawing Sheet

INTERLOCKING DOOR GUARD

BACKGROUND OF THE INVENTION

The present invention relates to securing doors from forced entry by means of a protective structure. My particular invention relates to a door guard that engages and disengages both vertical casing members during normal door use.

With most door guards security is achieved by bolting the guard directly to the door. During forced entry the door locks, and casing and hinges are put under great stress and often fail. My invention takes this stress away from the door and puts it on the door guard and the heavier middle part of both casing members, distributing the impact vertically along their lengths. Because of this unique feature, my invention is also an improvement over many outward swinging security doors that are often no stronger than the small contact area of the lock. It has further been found that double key deadbolt locks on security doors and other locks often do not meet security and safety requirements and are often difficult to use, especially by the handicapped, elderly and children who may have problems with mismatched or missing keys and turn nobs as they pass through a standard door and a security door, especially under emergency conditions.

SUMMARY OF THE INVENTION

Since my invention swings inward with the door and works automatically using no keyed locks, it meets requirements by many who have safety and security needs which includes condominiums and apartment houses that do not allow doors that swing outward into hallways, sidewalks or other restricted areas which may cause fire and safety and liability concerns. Another objective of the invention was to prevent accidental lockout due to the door being blown or slammed shut. This is achieved when the inertia of the closing door is counter-balanced by the inertia of the horizontal shifting door guard.

Because of its novel design, my door guard is able to operate between presently installed storm and screen doors, saving the expense of their loss if replaced by a security door, thus retaining the benefits they may provide.

My invention further addresses the need to be adaptable, saving inventory expenses. To achieve this, novel design features allow right or left hung door installation by turning the door guard end for end, and width adjustments are made within standard door sizes, depending on the depth of penetration by the horizontal bars into the casing.

The structure organization and operation of the invention will now be described more specifically in the following detailed description with reference to the accompanying drawings in which:

BRIEF DESCRIPTION OF THE DRAWINGS

FIG. 1 is an elevational view of the present invention illustrating the mounting of the door guard on the door, further illustrating the door opening in.

DETAILED DESCRIPTION OF A PREFERRED EMBODIMENT

Figure 2:
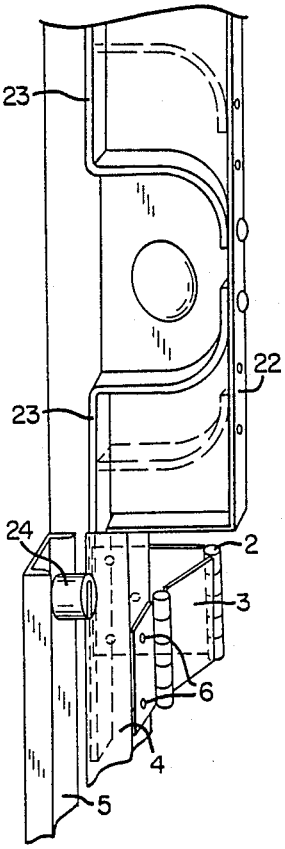
FIG. 2 is a partial perspective view of a lower double pivotal shift mechanism and lock guard of the invention with hidden areas illustrated by broken lines and shown mounted on a phantom door section.
Figure 1:
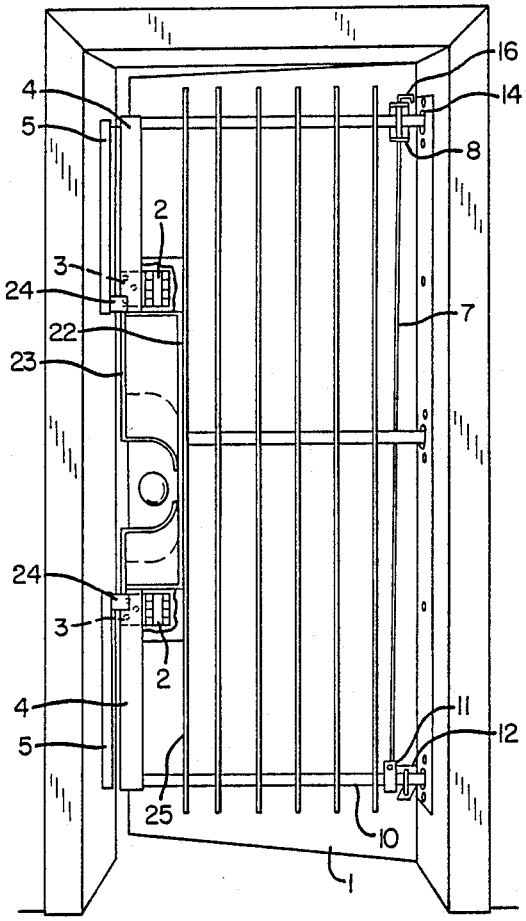
Figure 3:
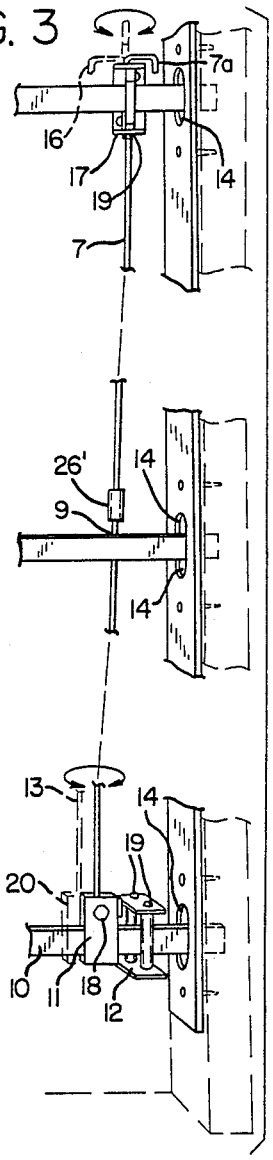
FIG. 3 is a broken perspective view of a torsion rod, guides and casing receptacle plate assembly.

Similar reference characters designate corresponding parts throughout the several figures of the drawing.

The interlocking door guard 25 is supported on the lock side of the door (1), by two double pivotal shift levers (2) of the present invention. These are constructed to support the weight of the door guard, yet allowing the double pivotal levers (2) free horizontal movement, in relation to its three hinge-like vertical members. The longest member (3) is attached by means of screws to the door close to its edge, thus assuring solid mounting material and easy access to said screws when the door guard is in open position.

This hinge member continues back parallel to the door to a pivotal position so that the middle section of the hinge can double back, such middle section being of a length so that when a short end section 6 is bolted to the lock bar (4) on the door guard, the latter will be interlocked into a channel receptacle (5) secured on the door frame. In FIG. 5 the middle member of the hinge will lay parallel to the door in the locked position and will swing out approximately 45° to give horizontal movement when the door is opened, disengaging the door guard, as in FIG. 4. Attachment of the short hinge section (6) to the lock bar (4), is preselected to provide sufficient clearance of adjustments in alignment and securement.

The door guard is further supported on the main door at its back or hinged side by means of a rod (7) attached to a guide member at the top (8) which supports the top horizontal door guard member without restriction its horizontal movement. The rod with suitable sound suppressor means (26) thereon extends down behind any other horizontal bars (9) of the door guard, to a bottom horizontal member 10 of the floor guard, the rod having a saddle clamp (11) secured to its lower end and the horizontal bar member resting in this clamp. The door guard is further supported in this area by a guide (12) similar in construction to be explaied to the top guide 8. Both these guides are nonrestrictive of horizontal movement of the top and bottom horizontal bars 10 of the door guard, in their limited movement along a plane parallel to the main door (1). This allows the horizontal bars of the door guard to have good alignment as they enter receptacle plate holes (14) in the casing.

Figure 4:
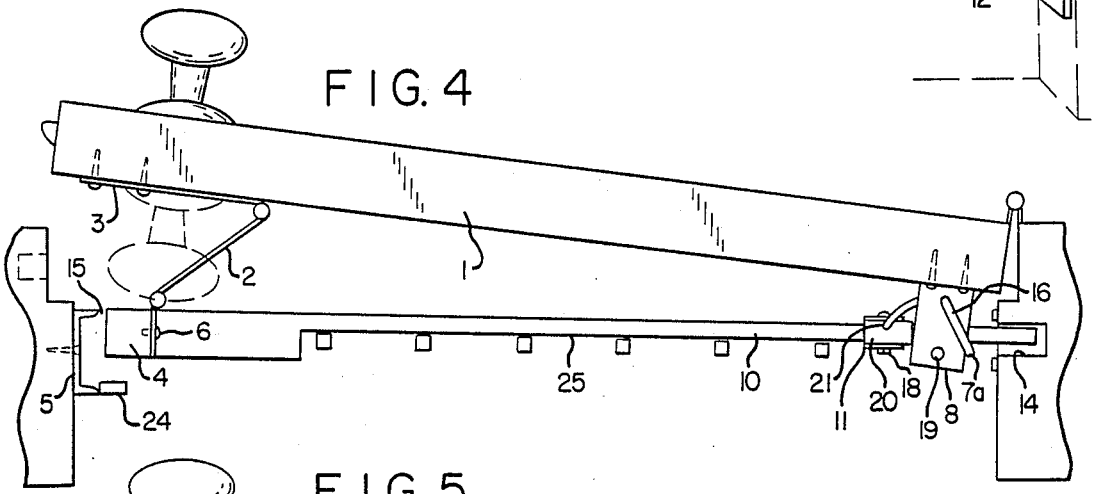
FIG. 4 is a top plan view illustrating the door and guard, its interlock mechanism being in disengaged position on the lock side.
Figure 5:
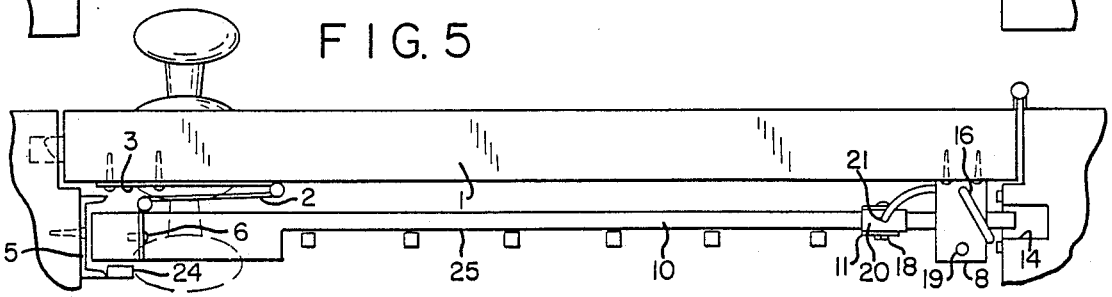
FIG. 5 is similar to FIG. 4 except that the door guard is in closed or interlocked position.

Referring to FIG. 4, the door is shown partially open, the shift hinge being open at approximately 45°, allowing the door guard to shift back, thus allowing the lock bars (4) to clear edge (15) without touching the channel receptacles (5). (16) shows the torison by means of arrows applied to the shift rod (7). This rod is flexible due to its length and diameter, thus giving adequate low friction movement horizontally through a limited arc (13). At the same time torsion pressure is set in the rod by means of a hook device (*7a*) protruding through the two back holes (17) and out the top of the upper guide with a horizontal bend and downward facing hook bend. Torsion is set from a slack position facing inward to an up, out and down on the back side of guide leg (16). Adjustments are made in the torsion rod saddle against the lower guide before tightening the clamping bolt (18) to provide clearance of the lock bar from the forward channel receptacles (5).

The top and bottom guides (8) and (12), respectively, are similar in configuration consisting of a vertical member with mounting holes bent at right angles, top and bottom ends to form horizontal legs. Two holes are located in each leg, one located on center near the bend, the other hole being outwardly located. These holes align in the top and bottom legs to accommodate guide bolts (19) in the bottom guide and outer hole of upper guide. The back holes receive the torsion rod which is then welded to the lower saddle clamp (8). The guide bolts (19) and torsion rod (7) have soft tubular material placed over them to reduce rattles as the horizontal bars pass through. Attachment of the guide bolts is achieved by nuts and washers at the top and bottom of each leg. The diameter of the bolts is smaller than the holes to fine adjust for nonbinding movement of the horizontal bars (10).

The saddle clamp (11) is constructed with a flat bottom surface and two flat upward bent members to form a width to hold the horizontal lower bar (10) and allow adjustment back and forward. Above the horizontal bar, in the upper bent members, are two holes aligned to support a clamp bolt (18). Directly above the bolt on one inside leg of the clamp is a weld connection for the lower end of the torsion rod (7). Within the open area and extending from the horizontal bar (10) upward to the top of the clamp (11) is a bumper made of sound deadening material (20). The bumper has a hole for fastening with the clamp bolt (18).

When the door guard is opened, the saddle clamp and bumper stop against the lower guide (8), limiting its movement.

The present invention has upper and lower lock bars (4) located at the front of the door guard and extending vertically at the top and at the bottom of a primary lock guard (22) fastened to the inside surfaces of the lock bars and the said shift levers (2). The primary lock guard is constructed of flat material extending in a horizontal plane to the rear slightly past the door locks, then joined by a vertical surface facing the door jamb. Said structure is attached back from the inside leading edge portion of the lock bars to form a close space sufficient to accommodate the adjustable lock guards within the hollow space of the lock bars.

The adjustable lock guard (23) is constructed of a strong vertical member of a sufficient length to be secure in its lock bar receptacal when fully extended. This lock guard has a right angle bend with an esthetically pleasing curve ending in a mounting hole against the primary lock guard (22) and one of several adjustment holes. This further protects vulnerable locks, yet allows access by key and hand clearance when operating the door.

The channel receptacles (5) are securely fastened on the casing, lock side, close to the door and aligned to compliment the lock bars (4) in the upper and lower sections of the door guard. On the outward leg of the two channels is located an extension of a length and width to function as a stopping plate (24) when door and door guard close, directing the lock bar (4) into the channel receptacles (5). The two said stopping plates have durable sound deadening material attached thereto.

The aforementioned door guard shall not be limited by its present design but is illustrative in nature.

In the manufacture and installation of the present interlocking door guard, the parts are dimensional and arranged such that the lock bar (4) will move horizontally into the channel receptacle (5) when the door (1) is fully closed and will clear the channel receptacle when the door is opened. This is accomplished by the shift lever assembly (2) by abutment of the lock bars (4) with abutments (24) in the channel receptacles (5), and by the torsion set in the torsion rod (7) during installation. More particularly, the torsion rod urges the guard door pivotally away from the main door in a direction to expand the shift lever assembly (2), namely, to the position shown in FIG. 4 wherein the guard door is angled relative to the main door. This expanded condition of the shift lever assembly (2) slidably positions the guard door in a right hand position wherein the lock bars (4) have clearance with the front edge (15) of the channel receptacles. Then, as the main door shuts, this angled disposition of the guard door will be maintained until the lock bars (4) abut against the stops 24. As the door continues movement to a fully closed position the shift lever assembly must contract and this contraction pulls the lock bars into the channel receptacles. The torsion developed by the rod (7) urges the lock bars against the stops (24) and thus when the door is opened, the lock bars will remain engaged with the stops (24) until the shift lever assembly (2) expands sufficiently to exert an outward pull thereon. When this outward pull occurs, the shift lever assembly will have slidably moved the lock bars away from the channel receptacles a sufficient amount to clear the front edge of the channel receptacles.

What I claim as new is:

1. A door guard for use with a main door of the type having hinged connection at one of its edges on one side of the door frame and closure means on its other edge adjacent a closure edge of the door frame, said door guard comprising:

a body member having opposite side edges arranged to be disposed adjacent respective side edges of a main door, one of said side edges including a locking edge and being disposed adjacent the closure edge of the door frame, socket means arranged to be provided on the closure edge of the door frame, and shift lever means arranged to support said body member on the main door for lateral movement relative to the door between engagement of said locking edge in said socket means of the door frame and clearance of said locking edge from said socket means, said shift lever means being arranged to move said body member laterally when the door is opened to clear said socket means but arranged to move said body member in the opposite direction to engage said locking edge with said socket means when the door is closed.

2. The door guard of claim 1 including spring operated torsion means arranged to urge said body member at said locking edge away from the main door in a partially open position of the latter to assist clearance movement of said locking edge from said socket means when the door is opened and closed.

3. The door guard of claim 2 wherein said torsion means comprises an upright flexible rod and assists said shift lever means in supporting said body member on the main door.

4. The door guard of claim 1 wherein said shift lever means is arranged to allow said body member at said locking edge to move away from the main door in a partially open position of said body member, and including spring operated torsion means arranged to urge said body member at said locking edge away from the main cdoor in a partially open position of the latter to assist clearance movement of said locking edge from said socket means when the door is opened and closed.

5. The door guard of claim 1 wherein said shift lever means comprises a hinge-like member having opposite ends, one such end being pivotally connected to said body member and being arranged to be connected at its other end to the main door, said hinge-like member being pivotally expandable and contractable to provide said lateral movement of said body member.

6. The door guard of claim 1 including stop means arranged to be mounted on the door frame selectively at said socket means for abutment by said locking edge in a closing movement of said body member with the main door to cause said shift lever means to move said body member for engagement of its locking edge with said socket means.

7. The door guard of claim 1 including second lock means on said body member on the edge opposite from said locking means arranged for locking engagement with an adjacent portion of the door frame.

8. A door guard for use with a main door of the type having hinge connection at one of its edges on one side of a door frame and closure means on its other edge adjacent a closure edge of the door frame, said door guard comprising:

a body member having opposite side edges arranged to be disposed adjacent the side edges of a main door, one of said side edges including a locking edge and being disposed adjacent the closure edge of the door frame, socket means arranged to be provided on the closure edge of the door frame, shift lever means arranged to support said body member oh the main door for lateral movement relative to the door between engagement of said locking edge in said socket means of the door frame and clearance of said locking edge from said socket means, and stop means arranged to be mounted on the door frame selectively at said socket means for abutment by said locking edge in the closing movement of said body member with the main door to cause said shift lever means to move said body member for engagement of its locking edge with said socket means.

9. A door guard for a main door in a door frame, said door guard comprising:

a body member having opposite edges and being arranged to be supported on a main door for opening and closing movements therewith, lock means on at least one edge of said door member, socket means arranged to be provided on the door frame, and actuating means on said body member and socket means arranged to move said body member laterally when the door is open to clear said socket means but arraged to move said body member in the opposite direction to engage said locking edge with said socket means when the door is closed.

* * * * *